United States Patent [19]

Wittkopf et al.

[11] Patent Number: 4,945,293

[45] Date of Patent: Jul. 31, 1990

[54] WEB TENSION CONTROL SYSTEM

[75] Inventors: Eugene W. Wittkopf, Little Suamico; Glen B. Leanna, Green Bay, both of Wis.

[73] Assignee: Integrated Design Corp., Green Bay, Wis.

[21] Appl. No.: 408,779

[22] Filed: Sep. 18, 1989

[51] Int. Cl.[5] ..... B65H 59/38

[52] U.S. Cl. ..... 318/7; 318/6; 318/12; 318/15; 318/618

[58] Field of Search ..... 318/6, 7, 8, 9, 11, 318/12, 13, 15, 268, 618; 242/75, 75.43, 75.44, 75.5, 75.51, 75.52; 74/710, 711, 713, 714, 715, 752 D, 847, 849

[56] References Cited

U.S. PATENT DOCUMENTS

| | | | |
|---|---|---|---|
| 2,906,143 | 9/1959 | Musser | 74/804 X |
| 2,995,968 | 8/1961 | Tomberg | 242/75.44 X |
| 3,049,313 | 8/1962 | Jordan et al. | 242/75.44 |
| 3,504,248 | 3/1970 | Miller | 318/618 X |
| 3,635,415 | 1/1972 | Phelps et al. | 242/75.5 X |
| 4,525,655 | 6/1985 | Walker | 318/11 X |
| 4,588,931 | 5/1986 | Alexander | 318/6 X |
| 4,663,573 | 5/1987 | Maetani et al. | 242/75.44 X |

*Primary Examiner*—Bentsu Ro

*Attorney, Agent, or Firm*—Fuller, Ryan & Hohenfeldt

[57] ABSTRACT

To control the draw exerted on a web which is being fed to the rolls of a web processing machine, a strain wave gear power transmission device has its power input shaft driven by the main drive shaft of the machine and its output shaft coupled to the rolls including the nip rolls of the machine which draw the web. The wave generator (W.G.) shaft of the device is driven continuously in a single direction and at a higher rotational speed relative to the power input shaft. Encoders provide concurrent pulses at rates indicative of the main shaft and W.G. shaft speeds. The ratio of the pulse ratio is determined and compared to a stored value which corresponds to percent of draw desired. Any resulting error signal is used to change the speed of the W.G. shaft and output shaft. High encoder pulse rates provide for resolving small speed and draw errors. The output shaft of the transmission drives groups of rolls of the machine by way of a plurality of belt drive systems.

18 Claims, 5 Drawing Sheets

WEB TENSION CONTROL SYSTEM

BACKGROUND OF THE INVENTION

The invention disclosed herein pertains to a system for maintaining a predetermined relationship between the operating speeds of two mechanical systems that are driven from a common line shaft which, in turn, is driven rotationally by an electric motor. One example of a use of the invention is to maintain a constant draw or tension in a web that is being drawn by the nip rolls of a chill roll assembly from a web printing press where the web is discharged from the chill roll assembly to a folder. Another example of its use is to maintain a predetermined tension in the web at the infeed end of a printing press between the infeed nip rolls and the printing press.

As is well known, production machines, such as multiple color unit printing presses which process webs, usually require maintaining a predetermined tension or draw, as it is commonly called, in the web in some part of the machine. One example where maintaining a predetermined draw is necessary is in association with a chill roll stand. A paper web after having been printed is pulled from the outfeed printing unit through a hot air dryer which evaporates the volatiles from the ink. The dried ink discharged from the dryer is soft when it is still warm. The paper is drawn by nip rolls in the chill roll stand. The stand has several rotationally driven rolls which are artificially cooled by circulating cold water or refrigerant through them. The web passes over these rolls which cool the ink and cause it to set before the ink reaches the nip rolls which pull or draw the web. If the ink were not hardened before being squeezed by the nip rolls, the ink would be smeared and the printed image would be spoiled.

It is important to maintain proper tension or draw in the web. If the tension in the paper web between the outfeed of the press and the nip rolls of the chill stand is too great the web may stretch and distort the printing or the web may break. A break not only results in scrapping a substantial length of web which was fed out before the press came to a stop but, even as bad or worse, it usually means at least one-half hour of lost production before rethreading the web through the chill roll stand is accomplished.

Before the invention disclosed herein was made systems were provided for controlling web tension. A known system uses a strain wave gearing power transmission device of the type identified by the Trademark "Harmonic Drive", to drive the chill stand. Strain wave gearing devices are described in substantial detail in U.S. Pat. No. 2,906,143 of C. W. Musser which issued on Sept. 29, 1959. In the known tension control system and in the improved system disclosed herein the power input or drive to the strain wave gearing transmission for a chill roll stand is derived from the main or line shaft which also drives all of the color printing units of the press.

The form of strain wave gearing power transmission device of interest here comprises an outer ring gear (circular spline) having internal teeth, a strain gear (flexspline) having external teeth and a strain inducer (strain wave generator). The strain gear resembles a thin metal cylindrical cup which is inside and concentric to the ring gear. A power output shaft extends from the closed end of the strain gear and its external teeth engage with the internal teeth of the ring gear at generally diametrically opposite places. The strain inducer is a cam which is fixed on a shaft and is mounted inside of and coaxially of the flexible toothed wall constituting the strain gear. The strain inducer cam is elliptical. The length of its major axis is such that two opposite sides of the inducer flex the strain gear radially outwardly at two generally diametrically opposite areas to effect engagement of some of the teeth at the two areas on the strain gear with the ring gear teeth. Teeth located in zones between the areas of engagement are not engaged because the minor axis of the strain inducer cam is too short to flex the zones radially outwardly. The strain gear and ring gear have the same diametral pitch but the ring gear teeth have a slightly smaller pitch diameter. The pitch diameter difference results from a number of teeth in the strain gear being fewer than the number of teeth in the ring gear. The difference in the number of teeth is a multiple of the number of areas in which the strain gear is deflected to engage the strain gear with the ring gear. The difference is two teeth when the strain inducer or strain wave generator, as it is otherwise called, constitutes an ellipse having two lobes. Assume for the sake of illustration that the known strain wave gearing device and the device used herein for driving chill rolls rotationally and for maintaining web tension each have an outer ring gear in which there are 202 internal teeth and a strain gear in which there are 200 teeth. The ratio of input to the output is 101 to 100. Assume, for example, that in the chill roll stand drive system which was implemented before the present invention was made, the outer ring gear of the Harmonic Drive is driven rotationally as the power input and the shaft which supports the strain gear (flexspline) is coupled to the chill rolls and is the power output. The strain inducer (wave generator) normally has essentially zero rotational speed for reasons to be discussed later. Assume, for example, that the pulley ratio of the output shaft of the strain gear device is 2:1 relative to the input of the chill roll stand so that to drive the chill rolls at 700 rpm the output shaft speed of the strain gear device should be about 1400 rpm to develop no tension or draw. If the strain inducer shaft is held against rotation, the ratio of the input or driven speed of the ring gear to the output shaft would be 101:100, it would be necessary to drive the ring gear at 1414 rpm to procure nominally proper web tension. However, it is desirable to hold the percent of draw constant even though the speed of the line shaft which delivers power to the printing press units and the chill rolls varies. Thus, a speed control system was adapted to the strain wave gearing through which power is transmitted to the chill roll stand according to the prior art. The control system involves having the output shaft of a servomotor coupled to the strain gear shaft. An encoder in the prior system produces electric pulses at a rate corresponding to the speed of the strain gear output shaft which, in turn, is proportional to the speed of the chill rolls. Another encoder produces pulses at a rate corresponding to the line shaft speed. The pulse signals are compared and otherwise processed. Now, for the sake of clarity that attends use of numerical examples, assume it has been determined that a draw of 0.0033 or 0.33% above zero draw is appropriate. At some moment, for example, the output pulse rate from the chill roll encoder corresponds to a web speed of 602 ft/min. At that moment the line shaft encoder yields output pulses at a rate corresponding to a web speed of about 600 ft/min. In this case, 602/600 equals 1.00333 or 100.333% draw. It is treated as 0.333% draw. So a processor using the pulse count produces an error signal representative of the difference between the actual draw and the desired draw. The error signal is used to energize the servomotor which then drives the strain inducer or wave generator rotationally in an appropriate direction and at a rotational speed to cause the Harmonic Drive to reduce its output. An encoder on the servoshaft produces pulses that are compared with the error signal and when the error signal is nulled by the decline of the strain gear output shaft speed and the chill roll speed equilibrium is reached so that draw supposedly would be restored to 0.33%. Underspeed would be conversely determined.

One problem with the prior art speed control method just outlined results from the strain inducer or wave generator shaft speed rotating at zero rpm for zero percent draw and from raising and lowering the wave inducer speed to get the output shaft of the strain gearing system to track the printing press or other web handling machine line shaft. In other words the prior art reference pulse rate developed by the wave generator shaft encoder is zero at zero draw and the pulse rate is low at the desired percent of draw. Hence the pulse rate incidental to the need for any amount of draw correction is low. A low pulse count from the encoders per unit of time means poor or gross resolution. A consequence is that the accuracy is poor, that is, there is a significant deviation from the desired percentage of draw before the system responds by changing the chill roll speed to get the proper draw.

Another problem with the prior art strain wave gearing power transmission application in a web printing press is that there is excessive bearing stress and heating that results from the driven ring gear shaft running at very high speed relative to the strain inducer or wave generator shaft when the normal speed of the latter is zero as it is in the prior art drive. This results in a dramatic reduction of bearing life. The Harmonic Drive in the prior art chill roll drive and tension control system has a housing in which the outer races of the bearings for a tubular or hollow ring gear shaft are set. The ring gear shaft fits into the inner races of these bearings. The strain inducer shaft is journaled concentrically in the hollow ring gear shaft. Since, in the prior art application of the Harmonic Drive the ring gear shaft, which is the power input, is driven at high speed and the strain inducer shaft is turning slowly or may even be standing still much of the time an output shaft speed mismatch exists. There is a huge difference in the speed of the ring gear shaft relative to the strain inducer shaft so the ball bearings must roll at higher than desired speed. This accounts for the heating and premature wear of the bearings mentioned above. Moreover, sometimes a negative speed direction requires driving the strain inducer in a direction opposite from the ring gear so the speed differential is even greater and so is bearing stress.

In prior art chill roll stand drives there is a toothed pulley on every chill roll shaft and a toothed pulley on the output shaft or the ring gear of the Harmonic Drive so a single drive belt runs on all of the pulleys and drives all of the high inertia chill rolls. In the prior art system the belt must be exceptionally wide which means its tension is high. This puts more load on the journals for the chill rolls which reduces bearing life. The high tension reduces belt life. A wide long toothed belt is much more costly than a plurality of narrower lower tensioned belts which are used according to the invention as will be discussed further later.

SUMMARY OF THE INVENTION

A primary objective of the invention is to provide apparatus which automatically regulates the output speed of a strain wave gear power transmission device in correlation with variations in the input speed so that when the transmission is applied to a web handling machine a highly precise preset amount of tension or draw of the web is maintained.

Another feature of the invention is to provide for maintaining a specified amount of tension in a paper web that is being drawn through a chill roll stand under the influence of the nip rolls in the stand.

Another feature is to provide for maintaining a specified amount of tension or draw in that part of a web which spans between the infeed nip rolls and the printing cylinders of a printing press.

Another feature, which is incidental to all applications of the improved drive system for web handling equipment, is to provide for high resolution speed sensing which keeps the output speed of the power transmission rigorously proportional to the input speed so the percent of draw which has been preset is held constant regardless of the speed variations of the line shaft, which drives all color units of a printing press under the influence of a single motor.

Another feature of the invention is to provide for reducing the cost of drive belts needed to rotate the pulleys on the chill roll shafts in a chill roll stand synchronously by providing for using a plurality of toothed belts instead of following conventional practice of using a single wide high tension and, therefore, costly toothed belt to transmit power from the strain wave gearing power transmission to the several chill rolls.

A further feature of the improved tension control system is that it provides for dividing among more than a single belt the belt stress that is developed when an emergency stop of the high inertia printing press units and the high inertia chill rolls must be accomplished in a short time such as within 5 seconds. In addition, the invention features maintaining the percent of draw or web tension substantially constant even during rapid deceleration of the press and chill rolls so the web does not fracture during an emergency stop.

How the foregoing objectives and other more specific objectives of the invention are achieved will be evident in the ensuing more detailed description of an illustrative embodiment of the invention which will now be set forth in reference to the drawings.

DESCRIPTION OF A PREFERRED EMBODIMENT

Figure 1:
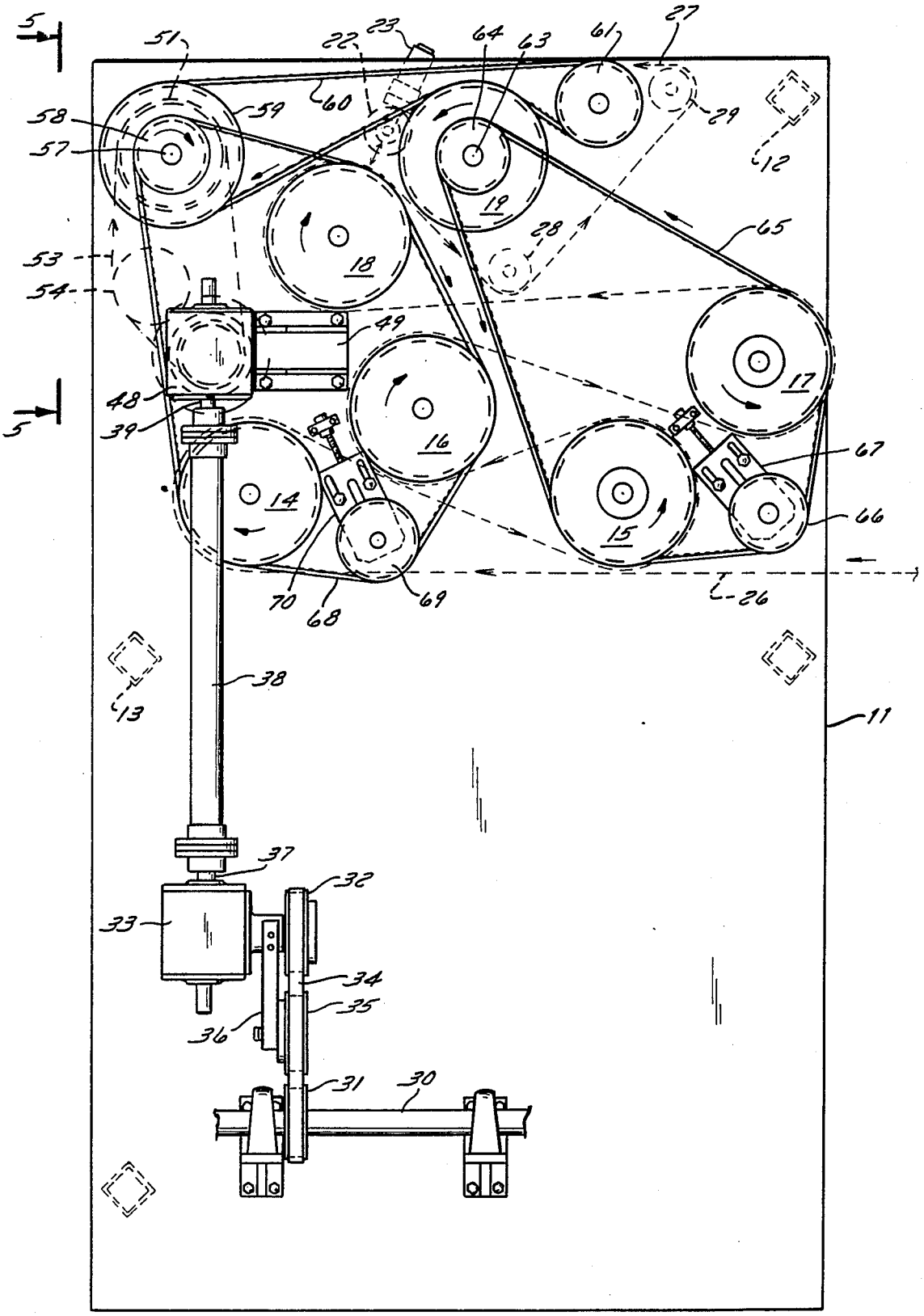
FIG. 1 is a view of a chill roll stand looking at the side of the stand from which the chill rolls are driven.
Figure 4:
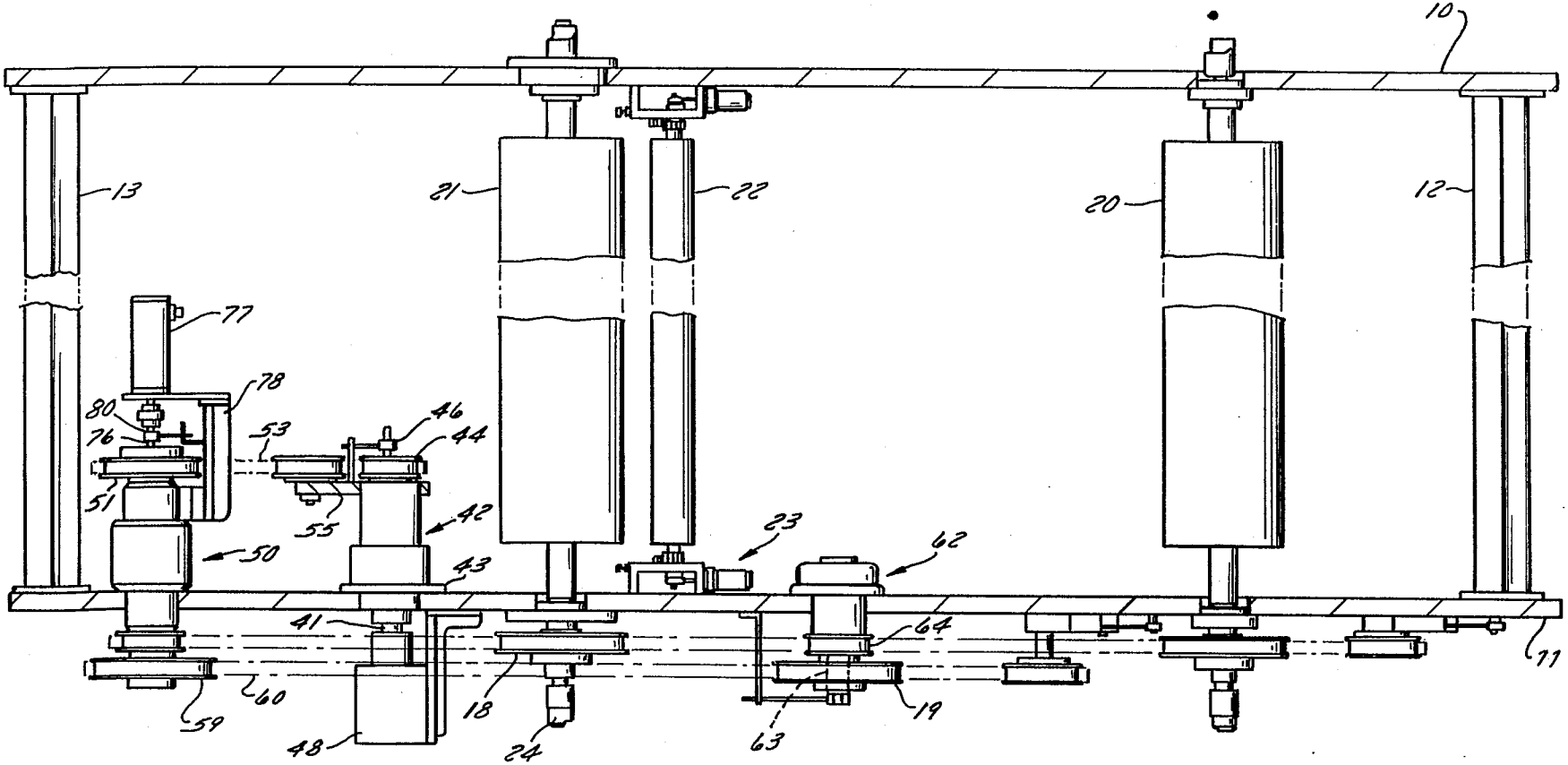
FIG. 4 is a plan view of a chill roll stand, showing the uppermost tier of chill rolls in place and showing the Harmonic Drive and the clutch pictured adjacent the drive for the sake of clarity instead of beneath it as it actually is in the illustrative chill roll stand.

Attention is invited to FIG. 1 which is an elevational view of a chill roll stand as viewed from the side of the chill roll stand on which the belt driven pulleys for the chill rolls are visible. The chill roll stand has a frame comprised of a vertical front plate 10 and a similar rear plate 11, both of which are visible in FIG. 4 but only plate 11 is visible in FIG. 1. The frame plates are held in parallelism with each other by means of tie-bars such as those marked 12 and 13 in FIGS. 1 and 4. Some of the tie-bars are omitted from FIG. 4 for the sake of brevity. There are several toothed pulleys 14, 15, 16, 17 and 18 visible in FIG. 1. There is a chill roll concentric and coaxial with each of these pulleys on the side opposite of rear frame plate 11 as that plate is viewed in FIG. 1. Two chill rolls 20 and 21 of a total of five actually installed in the illustrated embodiment are shown in FIG. 4. Also shown in FIG. 4 adjacent chill roll 21 is a nip roll 22 which is shown in retracted position relative to chill roll 21. Pneumatic drive mechanisms 23 retract nip roll 22 to allow threading the web between the rolls and upon command, urge roll 22 into tangential contact with chill roll 21 so that by rotating the chill roll tension is created in the web. Roll 21 has a coolant connector 24 coupled to it. In FIG. 1 a paper web 26, indicated by a dashed line is fed into the chill roll stand from right to left. Following the path of the web 26 through the chill roll stand is aided by following the arrowheads which are inserted in the dashed line which represents the web. The web first passes over the chill roll which is coaxial with the toothed pulley 14 and over the rolls which are coaxial with toothed pulleys 15, 16, 17, 18 and then out of the chill roll stand as indicated by the arrowhead marked 27 at the top of the stand. During its course through the chill roll stand, the web 26 also passes around some direction changing idler rolls 28 and 29 which, of course, are on the back side of the rear frame member 11 as viewed in FIG. 1.

The source of power for driving the toothed pulleys is the main shaft 30 from which the several printing press color units, not shown, are also driven. Thus, it will be evident that the color units and the chill roll stand and other stages in the printing system are all driven synchronously from a shaft 30 which is driven by a motor, not shown. There is a toothed pulley 31 mounted on the main shaft 30. It drives, by way of a toothed belt 34, another toothed pulley 32 which is on a shaft extending horizontally from a gear box 33. A toothed pulley 35 on a swingable arm 36 is for adjusting the tension on belt 34.

Figure 5:
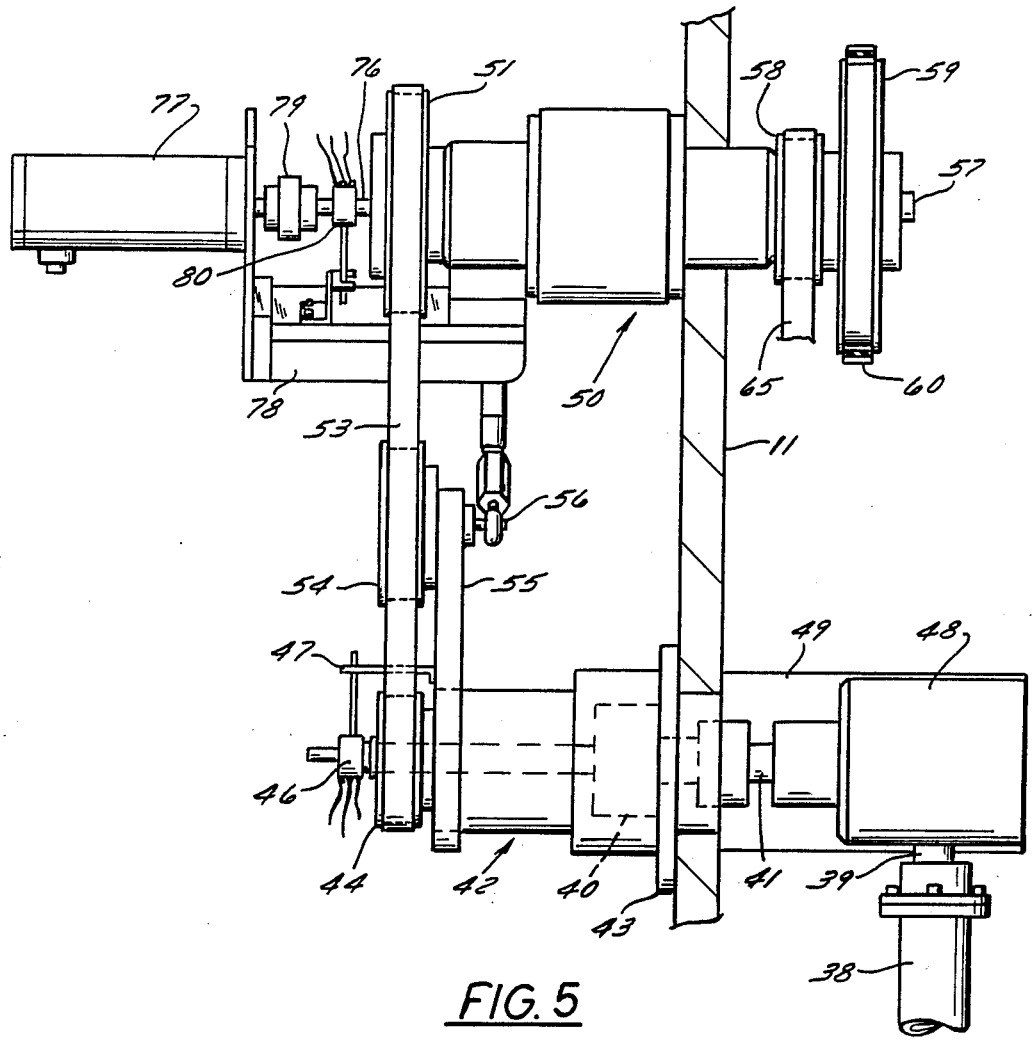
FIG. 5 is an elevational view of a part of the chill roll stand drive system as viewed in the direction of the arrows 5—5 in FIG. 1, this view showing the "Harmonic Drive" located above the power input clutch as it is in reality.

An output shaft 37 from gear box 33 is coupled to a torque shaft 38 which connects to the input shaft 39 of a gear box 48 which is mounted to the foremost side of the chill roll frame plate 11 by means of a bracket 49. As shown in FIG. 5, a shaft 41 is coupled to a clutch 40. An input drive housing 42 containing the clutch and bearings, not shown, for shaft 41 is secured to rear frame plate 10 by means of a flange 43. There is a toothed pulley 44 mounted to shaft 41. An encoder 46 supported on a bracket 47 is driven by a shaft 45. For the present time it is sufficient to know that encoder 46 produces electric pulses at a rate which is indicative of the rotational speed of the main shaft 30 of the printing press.

The invention provides for increasing or decreasing the rotational speed of the chill rolls with heretofore unachieved accuracy and with minimal delay when the main shaft speed increases or decreases, respectively, such that there is never a consequential change in the preset percent of draw of the web.

Attention is invited to FIGS. 4 and 5. FIG. 5 shows that the strain wave gearing device, called a Harmonic Drive herein, for convenience, is designated generally by the reference numeral 50 and is mounted to the front side of rear frame plate 11 directly above input drive 42. The FIG. 5 arrangement wherein the input drive 42 and the Harmonic Drive 50 are shown one above the other is consistent with FIG. 1 and the actual machine. In FIG. 4 the input drive 42 and Harmonic Drive 50 are drawn next to each other, in conformity with current engineering drawing practice to avoid having one item hidden and confused by the other.

Figure 3:
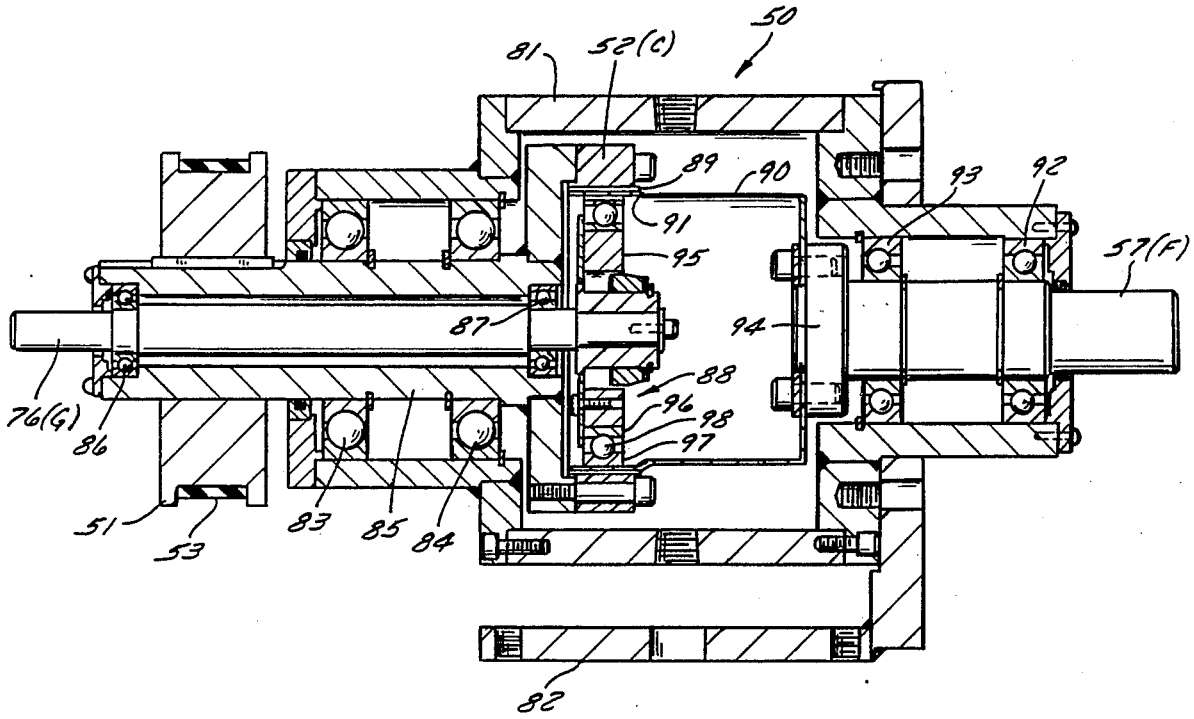
FIG. 3 is a transverse sectional view of a strain wave gearing power transmission device which is known by its commercial name, Harmonic Drive.

FIG. 5 shows that the pulley 44 on the input drive unit 42 drives a toothed pulley 51 of the Harmonic Drive 50 by means of a toothed belt 53. Pulley 51 is the power input for driving the outer or ring gear 52 (see FIG. 3) of the Harmonic Drive. The letter C in parentheses next to 52 in FIG. 3 is for the purpose of concisely designating ring gear 52, or circular spline as it is sometimes called in calculations which are presented later. Discussion of the Harmonic Drive per se will be deferred until the overview of the chill stand is completed. FIG. 5 shows an idler pulley 54 mounted for rotation on a swingable arm 55 which is for urging pulley 54 against belt 53 as required for maintaining tension in toothed belt 53. The eye of a turnbuckle bolt 56 is engaged with arm 55 for pressing the pulley 54 against belt 53. The power output shaft 57 of the Harmonic Drive has two toothed pulleys 58 and 59 fastened to it. The larger diameter pulley 59 has a belt 60 running on it which has teeth on both sides. The letter F in parentheses next to 57 in FIG. 3 is for concisely designating the output shaft 57, or flexspline shaft as it is often called, in calculations presented later.

Shifting attention to FIG. 1, one may see that the inside teeth of the comparatively short closed loop belt 60 run on toothed pulley 59 and a toothed idler pulley 61 and that the outside teeth of belt 60 engage the peripheral teeth of a pulley 19 in driving relation. Pulley 19 is not coaxial with any of the chill rolls. Instead, a pneumatically operated brake 62, shown in FIG. 4, is coupled to the shaft 63 in which pulley 19 is fixed. The brake is used primarily when an emergency stop of the press must be made in which case the motor, not shown, which drives the main shaft 30 is stopped by dynamic braking primarily. The drive system described herein uses a unique method of decelerating and distributing the inertia of the chill roll and other moving parts during an emergency stop as will be explained.

Brake shaft 63 has another toothed pulley 64 fastened to it as can be seen in FIGS. 1 and 4. A toothed belt 65 runs on driven pulley 64 and engages the peripheral teeth of pulleys 15 and 17 in driving relation and it also runs on an idler pulley 66 which is mounted for rotation on a bracket 67. There are chill rolls on the shafts of pulleys 15 and 16. The bracket 67 is slidable to press idler pulley 66 against the belt 65 to adjust its tension. The outside teeth of the double sided belt 60 engaged with the teeth of the pulley 19 on brake shaft 63 and during normal operating conditions, drive that pulley.

Observe that the double sided belt 60 is stressed to the extent that it is transmitting power to only the two chill rolls, of the total of five in this embodiment which are coaxial with pulleys 15 and 17. The importance of this innovation will be explained later when the functions performed in connection with an occurrence of emergency stop are discussed.

Referring to FIGS. 1 and 5, but FIG. 1 primarily, the other toothed pulley 58 on the power output shaft 57 of Harmonic Drive 50 drives a toothed belt 68 that engages the peripheral teeth of pulleys 14, 16 and 18 which are each coaxial with a chill roll. The belt 68 also runs on an idler pulley 69 which is rotatable on a slidable bracket 70 that is adjustable for belt tightening. Thus, in this embodiment, belt 68 transmits power to three chill rolls 14, 16 and 18, while double sided belt 60, by way of pulley 19 and belt 65, transmits power to chill rolls 15 and 17. This division of power not only has a significant purpose in connection with the system during an emergency stop of a printing press but it also avoids driving all the chill rolls with a single belt as is customary in prior art chill roll stands. A single long closed loop toothed belt used in prior art drives which must weave at least partially around all of the chill roll pulleys is dramatically more costly than the three belts 60, 65 and 68 used in the new design. Moreover, belt life is extended with the new arrangement.

Refer to FIG. 5 for identification of some additional parts of the system. In FIG. 5 a servo motor 77 drives the shaft 76 of the strain inducer, or the strain wave generator as it is otherwise called, in the Harmonic Drive 50. The letter G in parentheses next to 76 in FIG. 3 is for the purpose of designating the strain wave generator shaft in some calculations to be presented later. Servomotor 77 is mounted to a bracket 78. A coupling 79 couples the shaft of servomotor 77 to strain inducer shaft 76. There is an encoder 80 which produces electric pulses indicative of the servomotor 77 speed.

The commercially available Harmonic Drive 50 is depicted in FIG. 3 and will be briefly described. The operating principles of this drive are described in previously mentioned U.S. Pat. No. 2,906,143. In FIG. 3, the Harmonic Drive comprises a housing 81 having a mounting bracket 82. There are two ball bearings 83 and 84 mounted in one end of the housing. These bearings support a tubular shaft 85 for rotation. Shaft 85 has a circular spline or ring gear 52(C) mounted concentrically on it. Tubular shaft 85 is the main power input shaft to the Harmonic Drive. As previously mentioned, it has toothed pulley 51 fastened to it. This pulley is driven by belt 53 which, as shown in FIG. 1, runs at the speed of the main press shaft 30 and transmits the power for driving all of the chill rolls. There are two ball bearings 86 and 87 inside of tubular shaft 85. These bearings support the wave generator or strain inducer shaft 76 for rotation. The strain inducer is designated generally by the reference numeral 88 and is fastened to shaft 76 which is also designated by the symbol G for the purpose of calculations to be presented later. The outer ring gear 52, or circular spline which it is also called, is rigid. It has rigid internal teeth 89. A cup shaped strain gear 90 is arranged concentrically inside of ring gear 52. The strain gear 90 is otherwise called a flexspline which is formed of a flexible elastic usually metallic member. There are gear teeth 91 formed around the rim or open end of the strain gear. If a two-lobe elliptical strain inducer cam 88 is used, as it is in this case the number of external gear teeth 91 on the strain gear will be two less than the number of teeth 89 on the ring gear. Assume in this example that there are 202 internal teeth 89 on the ring gear and 200 external teeth 91 on the strain gear 90. In such case, if the strain inducer 88 or wave generator is held against rotation, for every 101 turns of the power input ring gear 52 the power output flexspline or strain gear 90 will rotate 100 revolutions. If the strain gear shaft 76 and the wave generator or strain inducer 88 are driven at the same rotational speed as the ring gear 52, the power output shaft 57 will rotate at the same speed as the ring gear 52 and the flexspline strain gear 90. The output shaft 57 is journaled in ball bearings 92 and 93 whose outer races are fixed in housing 81. Output shaft 57 is connected to the cup-shaped strain gear 90 by means of bolts which pass through the strain gear and are threaded into a flange 94. The wave generator or strain inducer 88 comprises a solid cam 95 which is elliptical and has a major and a minor axis. There are flexible rings 96 and 97 fitted on the elliptical cam with bearing balls 98 between them. It will be evident that the strain inducer shaft 86 is rotated balls 98 will roll on inner flexible ring 96 and a flexing wave will be generated through outer flexible ring 97 around the array of teeth 91 on the flexible strain gear 90 so as to advance or retard the strain wave gear relative to the ring gear depending on the direction of rotation of the strain wave inducer 88.

In known systems which use a Harmonic Drive to drive a chill roll stand or the like, a shaft comparable to tubular shaft 85 is driven at a very high rate of speed and the strain inducer 88 is either standing or running at a very low rotational speed in order to obtain a desired speed such as about 1400 rpm, by way of example and not limitation, for the output shaft 57. Since according to prior practice ring gear 52 turns at a very high speed relative to shaft 76, bearings 86 and 87 experience the stress and premature wear which is a concomitant of high relative rotational speed. However, it is the wave inducer bearing components 96, 97 and 98 which are the most frequent place of failure in Harmonic Drives in prior art applications. In the prior art design, when the wave generator shaft 76 and strain inducer cam 95 are turning at nearly zero or at very low speed as is usually the case, the flexspline 90 will be rotating at substantially the same speed as the circular spline or ring gear 52 at zero or near zero draw. But a positive draw is usual in which case in the prior art the wave inducer 95 will be turning in a direction opposite of the ring gear so the wave generator shaft speed is added to the ring gear speed to obtain an output shaft speed which will produce the desired percent of draw. Thus, the speed differential between the flexspline 90 and wave generator elliptical cam 95 is large. Thus, the rotational speed of the outer flexible ring 97 of the wave inducer is high compared to the inner flexible ring 96 of the wave inducer. Therefore, the ball bearings 98 run on inner flexible ring or race 96 at high speed at all times in which case they will have short life. Therefore, lower differential speeds make a substantial contribution to extending life.

According to the invention, as will be elaborated a little later, the strain wave generator shaft 76 is rotated continuously at a speed which is much closer to the speed of the main power input tubular shaft 85 of the ring gear so relative speed is lower which means that the bearing components 96, 97 and 98 experience dramatically lower physical and thermal stress as compared with the prior art. Driving the wave generator shaft 76 at a rather high speed by way of servomotor 77 results in more output pulses from encoder 80 so resolution of small speed changes is high in accordance with the invention.

In the embodiment of the invention described in detail herein, the input power to the Harmonic Drive is applied to the ring gear or circular spline 52 and the power output is taken from the shaft 57 of the flexspline 90. It is well known, however, that the power flow direction in the drive can be reversed to obtain similar results; that is, the input power can be applied to the flexspline shaft 57 and the power output can be taken from the circular spline or ring gear shaft 85. Regardless of the operating mode which is adopted, all of the statements made herein and the illustrative calculations remain valid.

The improved sensitivity and resolution of main shaft speed variations and the improved adjustment to the present percentage of draw that is achieved with the invention over prior practice will be demonstrated by presenting the following numerical examples of each for the purpose of comparison. The demonstration should be considered illustrative rather than limiting.

The equation for the speed, NF, of the flexspline or output shaft F (57) of the Harmonic Drive 50 is as follows:

$$NF = \left[ NC \cdot \frac{R+1}{R} \right] - \frac{(NG)}{R} \qquad \text{(Equation 1)}$$

where:

NF is the rpm of the flexspline 90 and output shaft 57(F).

NC is the rpm of the circular spline or ring gear 52(C).

NG is the rpm of the wave generator servomotor driven shaft 76(G).

(R+1/R) is the spline tooth ratio of 101/100 for a two-lobe elliptical wave generator or strain inducer 88.

Calculations pertaining to the new mode of operation, according to the invention, will be given first and then a similar calculation pertaining to prior practice will be given.

Assume the system design for a nominal speed of 700 rpm for the chill rolls at zero percent draw. For rolls 13.688 inches in diameter this corresponds to a linear web speed of 2508.46 fpm. In the design described herein there is a 2:1 ratio between the output shaft 57 of the Harmonic Drive 50 and the chill rolls so the output shaft 57(D) will run at 2×700=1400 rpm at a nominal or zero percent draw.

Requirements for the speed of the Harmonic Drive output shaft 57(F) must be chosen depending on the web material, its thickness, width, etc. which skilled designers in the art can do. The Harmonic Drive shaft 57(F) output speed for various draw percentages are specified in the example as:

speed at maximum desired draw (1400+0.5%)=1407.0 rpm typical operating draw speed (1400+0.3%)=1404.2 rpm speed at zero draw (1400±0.0%)=1400 rpm minimum draw speed (1400−0.5%)=1393 rpm As indicated previously, for a given circular spline or ring gear 52(C) input speed, the speed change of the output shaft 57(F) is inverse to the speed change of the wave generator or strain inducer shaft 76(G). Thus, the maximum draw speed requires wave generator shaft 76(G) to be operating at minimum speed. The desired minimum speed of the wave generator is chosen as 1600 rpm. Therefore, the subtractive portion of equation 1 is limited to approximately −NG/R=1600/100=16 rpm. This condition relates to a speed change of plus 0.5%. For various reasons, the design parameters should be such that the maximum speed of the wave generator never has to exceed a speed of 5000 rpm.

By using equation (1) the Harmonic Drive input speeds (NC) of the circular spline or ring gear 52 can be determined. NC =1408.92 for maximum, typical, zero and minimum draw percentages corresponding to output shaft 57(F) speeds of 1407.0, 1404.2, 1400 and 1393 rpm given above.

As indicated above for a plus 0.5% maximum draw the Harmonic Drive output shaft 57(F) speed, (NF), is 1407.0 rpm and the corresponding wave generator or strain inducer shaft 76(G) speed, (NG), is 1600 rpm. As also previously shown, for a minus 0.5% minimum draw the Harmonic Drive output shaft 57(F) speed, (NF), is 1393 rpm and the corresponding wave generator shaft speed, (NG), is 3000 rpm. By proportionality at a typical operating speed draw of 0.3% the output shaft 57(F) speed, (NF), is 1404.2 rpm and the wave generator shaft 76(G) speed, (NG), is 1880 rpm. For a nominal 0.0% draw, the output speed is 1400 rpm and the wave generator shaft 76(G) speed, (NG), is 2300 rpm and for a minus 0.5% output shaft speed at 1393 rpm, the corresponding wave generator shaft speed is 3000 rpm.

In this example the speed, (NC), of the power input circular spline or ring gear 52(C) for the selected percentages of draw is determined by making substitutions in equation (1) since there is only one variable to solve for. Thus, in the case of plus 0.5% draw, 1407 rpm drive output speed and a wave generator shaft speed of 1600:

$$\left[ (NC) \times \frac{101}{100} \right] - \frac{(NG)}{100} = NF$$

$$[(NC \times 1.01] - \frac{1600}{100} = 1407$$

$$NC = 1408.91 \text{ rpm.}$$

Now, assuming that the input speed of the circular spline or ring gear is held constant at 1408.91, one may get an overall view of the Harmonic Drive conditions for plus 0.3%, 0.0% and minus 0.5% draws too.

For .3% draw:

$$\left( 1408.91 \times \frac{101}{100} \right) - \left( \frac{1880}{100} \right) = 1404.8 \text{ rpm} = (NF)$$

For .0% draw:

$$\left( 1408.92 \times \frac{101}{100} \right) - \frac{(2300)}{100} = 1400 \text{ rpm} = (NF)$$

For minus .5% draw:

-continued $$\left(1408.92 \times \frac{101}{100}\right) - \frac{(3000)}{100} = 1393 \text{ rpm} = (NF)$$

The example just given is realistic. In practice the higher percent draw percentages are used most of the time. As has been shown, the higher the draw percentage, the smaller and differential speed between the flexspline and wave generator bearing components 96, 97 and 98 and, therefore, the life of these components will be longer. To generalize, according to the invention, when the wave generator speed is the average of the minimum and maximum selected wave generator speeds the draw will be approximately zero percent. For a wide range of draw percentages the speed differential between circular spline or ring gear 52(C) and the wave generator or wave inducer shaft 76(G) is small compared to prior practice where the only time the wave generator shaft turns is when the line shaft speed changes from nominal speed so there is always during operation, a big differential between the wave generator shaft and ring gear shaft speeds. Consequently, the new method results in the Harmonic Drive having a longer life. In the illustrative example where the draw is 0.3% which most frequently prevails, the circular spline or ring gear speed is 1408.91 rpm and the wave generator shaft speed is 1880 rpm so the difference between the two speeds is only 471.09 rpm which the wave generator shaft bearing components 96, 97 and 98 experience. It should be observed that the circular spline or ring gear shaft 52(C) and the wave generator shaft 76(G) always turn in the same direction, according to the invention and the normal operating speed of the wave generator shaft is always far above zero, according to the invention. The advantage of this is that resolution is always high since the encoder which indicates wave generator or strain inducer shaft speed yields at least 250 pulses per revolution and that resolution exists even if there were only 1 rpm difference between shafts.

According to prior practice, assuming for the sake of example that all other factors are equal, where the wave generator shaft is at zero speed for zero draw, the term (NG/100) in Equation (1) can be plus or minus. Here the main shaft of the press would have to be geared such that the output of the Harmonic Drive shaft 57(F) would also be 1400 rpm to compare with the previous example. The input shaft speed NC would have to be 1386 14 rpm at zero draw. Thus:

$$\left(1386.14 \times \frac{101}{100}\right) - \left(\frac{0}{100}\right) = 1400 \text{ rpm} = NF$$

At zero draw, the servomotor 77 which controls wave generator shaft speed, NG, will oscillate between forward and reverse rotation.

If the Harmonic Drive input speed (NC) is assumed to be 1386.14 to obtain zero draw then, if this speed is held the following conditions would exist for draws of 0.5%, nominal 0.3% and minus 0.5% according to Equation 1.

For +.5% draw:

-continued $$\left(1386.14 \times \frac{101}{100}\right) + \frac{700}{100} = 1407 \text{ rpm} = (NF)$$

For +.3% typical draw:

$$\left(1386.14 \times \frac{101}{100}\right) + \frac{420}{100} = 1404.2 \text{ rpm} = (NF)$$

For −.5% draw:

$$\left(1386.14 \times \frac{101}{100}\right) - \left(\frac{700}{100}\right) = 1393 \text{ rpm} = (NF)$$

At the typical +0.3% draw the wave generator shaft 76(G) and the circular spline or ring gear 52(C) are rotating in opposite directions. Therefore, the relative speed is 1386.14+420 1666.14 rpm as compared with 471 rpm in accordance with the invention.

According to the invention, the ring gear tubular shaft 85 and the wave generator or strain gear shaft 76 rotate in the same direction and the difference in speeds is reasonable so the bearing components 96, 97 and 98 experience only the difference rather than the 3000 rpm absolute rotational speed of the wave generator shaft 36. So in this example where the servomotor is driving the wave generator shaft at 3000 rpm and the ring gear shaft 85 is running at 1408.9 rpm the speed difference is only 1591 rpm and this is a relatively low rotational speed which the wave generator shaft bearings 86 experience. Now it will be evident that the speed of the output shaft 57 can be altered or trimmed simply by changing the speed of the servomotor and, hence, the wave generator shaft 76.

Adjusting the speed of the wave generator shaft to change the speed of the output shaft of the HD for correcting draw of the web is disclosed in the prior art. According to prior practice, the reference speed of the wave generator or strain wave inducer shaft 76 is zero rpm instead of about 2300 rpm according to the invention for the same parameters. If the output shaft 57 of the HD in the prior art operating mode were to run at 1407 rpm for the desired draw, the power input shaft 85 and the ring gear 52 thereon would be driven at 1386.14 rpm and the wave generator would need to de driven at 700 rpm in the opposite direction so that 1386.14+700=2086 rpm. Wave generator bearings 83 and 84 as well as bearing components 96, 97 and 98 experience this rotational speed in prior art designs so they are undergoing substantial life reducing thermal and mechanical stress.

Moreover, in prior practice, if the chill roll speed is at zero draw and a positive correction is required, the correction is made by slowly rotating the strain inducer (wave generator) shaft by means of the servomotor in the direction opposite of the direction in which the ring gear (circular spline) is rotating. The faster the strain inducer rotates, the greater the positive correction of the chill roll.

If the chill roll speed is at near zero draw and a negative correction is required, the correction is made by slowly rotating the strain inducer shaft in the same direction in which the ring gear is rotating. The faster the strain gear shaft rotates the greater the chill roll negative correction.

The foregoing examples clearly show that the slowly rotating strain inducer shaft will produce very low numbers of encoder pulses so small speed errors cannot be resolved nor corrected. Using a wave generator shaft encoder which produces 250 pulses per revolution, for example, results in production of many more pulses per second and greater time resolution where the wave generator shaft is rotating fast, as in applicants invention, as compared with the poor resolution obtainable in prior practice where the wave generator shaft may be turning at near zero rpm.

When the strain inducer shaft runs at zero rpm or in a direction opposite from the ring gear shaft 85, bearings 86 and 87, and even more disadvantageously, bearing components 96, 97 and 98 experience even greater stress.

According to the invention, by having the wave generator shaft 76 running at high absolute speed but at a low speed relative to the ring gear shaft 85 greater resolution or sensitivity to shaft speed fluctuations are now obtainable. Hence, with the new method, the draw of the web can be held extremely constant during normal operation of the press and chill rolls.

How precise and accurate maintenance of the tension or percent of draw of the web is obtained with the new design will be explained in reference to FIG. 2 primarily.

Figure 2:
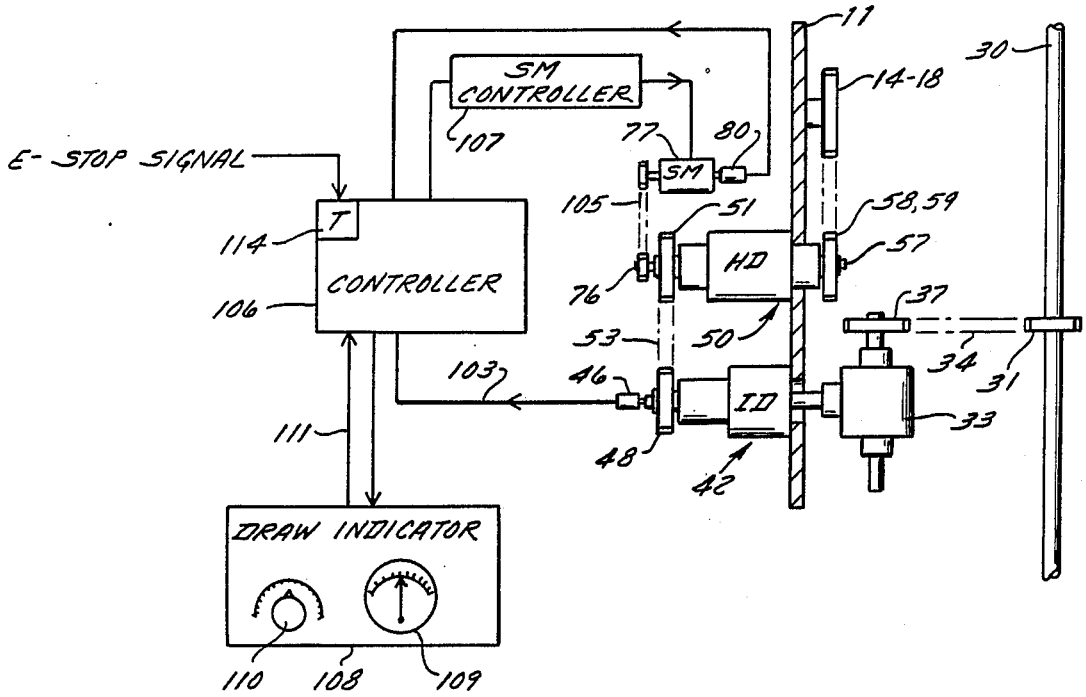
FIG. 2 is a diagrammatic plan view of the mechanism for transmitting power from a machine line shaft to the input shaft of a chill roll stand in combination with a block diagram of the electric control circuitry.

FIG. 2 is a schematic representation of the mechanical and electrical components of the system which facilitate explaining how the controls function. In FIG. 2, as previously explained in reference to the other figures, the main drive shaft 30 of a web handling machine such as a printing press transmits power by way of a gear box 33 to the input drive 42 whose output pulley 48 delivers power by means of a belt 53 to the power input pulley 51 of the HD 50. There is a previously identified main shaft 30 reference speed encoder 46 which is driven by the input drive. By way of example, encoder 46 produces 250 electric pulses per encoder revolution in one model of the machine. If faster pulse counters, not shown, in controller 106 are selected, encoders yielding as many as 500 pulses per second might be used. The pulse output rate of reference speed encoder 46 is proportional to the rotational speed of main press shaft 30. An illustrative nominal speed of line shaft 30 might be about 2000 rpm. Thus, the reference frequency of encoder 46 which is delivered to conductors 103 and 104 is on the order of 500,000 pulses per minute (ppm) which corresponds to a frequency of 8.3 kHz. The high pulse count permits high draw resolution.

The ring gear of the Harmonic Drive, HD, 50 is rotated by pulley 51 which is directly driven from output pulley 38 of the input drive, ID, 42. The two pulleys 58 and 59 which are fastened to the output shaft 57 of the HD are represented by a single pulley in the FIG. 2 schematic diagram. Pulleys 58 and 59 drive toothed pulleys 14–18 which are the pulleys on each of the chill rolls and are represented by a single pulley in FIG. 2. It will be evident that in order to create tension in the web the nip of the chill roll stand must tend to draw the web faster than it is being fed out of the press. The control system, of course, keeps whatever percent of draw is set by the operator even though the absolute value of the rotational speed of main shaft 30 fluctuates. A more definitive explanation of how the percent of draw desired is set by the press operator and how the draw is maintained regardless of main shaft 30 speed fluctuations will be given shortly hereinafter.

In FIG. 2 the servomotor 77 drives the strain inducer or wave generator shaft 76 of the HD 50 to correct the output speed of the HD 50 for speed fluctuations of main shaft 30. As previously explained, the servomotor 77, labeled SM in FIG. 2, is directly coupled to the wave generator shaft 76 of the HD but is shown in FIG. 2 as being connected with a symbolic belt marked 105. In any event, wave generator shaft 76 will be driven at the speed of the servomotor. Encoder 80 is driven by servomotor 77 and its output pulse rate corresponds to the speed at which the wave generator shaft 76 is being driven. The encoder 80 used in the illustrated model of the machine yields 250 pulses per revolution. The servomotor 77 actually makes the rotational speed adjustment of the wave generator shaft 76 to maintain a constant percent of draw and encoder 80 produces pulses which are processed and compared with the reference frequency from encoder 46 to determine when equilibrium has been reestablished after a fluctuation in the rotational speed of main shaft 30. For reasons which will be given later, the new system can respond to a main shaft speed fluctuation and restore equilibrium or the percent draw with great precision within 10 ms.

The manner in which the controls function to maintain the preset draw obtained in the FIGS. 1–5 embodiment will now be discussed in reference to FIG. 2 primarily. For facilitating understanding typical numerical parameters will be used but this should be considered illustrative rather than limiting. Assume, for example, that the highest allowable speed of servomotor 77 is 3000 rpm. This is also the highest speed at which the wave generator shaft 76 will run at a ratio of 1:1 between motor and shaft. The highest speed for the wave generator shaft 76 corresponds to the lowest speed of the Harmonic Drive output shaft 57 and vice versa. At a 3000 rpm speed for wave generator shaft there is minimum or minus draw which could be minus 0.5% if the values from the earlier calculation are used. Thus, a signal corresponding to a pulse count from servomotor encoder 80 representative of 3000 rpm for the wave generator shaft 76 is stored in controller 106. All operator selected draw percentages will be proportional to 3000 rpm or its equivalent number of encoder 80 pulses which would be 3000 rpm$\times$250 ppr$=$750,000 pulses, providing for high resolution. As previously calculated, if a wave generator shaft 76 speed of 3000 rpm is equivalent to a minus 0.5% draw and 1600 rpm is equivalent to a plus 0.5% draw, then by proportionality the wave generator shaft would run at the average of 1600 and 3000 or 2300 rpm for zero percent draw.

In FIG. 2, the press operator rotates a potentiometer 110 for sending to controller 106 a signal which corresponds to the percent of draw desired. The selected percent of draw resulting from adjustment of the potentiometer can be visualized concurrently by viewing an analog meter 109 whose scale is calibrated in terms of percent of draw. The scale may have a range of minus 0.5% draw to plus 0.5% draw.

It is the fluctuations in the speed of main press and chill roll stand drive shaft 30 which must be compensated instantaneously to maintain a constant percent of draw in the web by the chill roll nip. Thus, the reference pulses from shaft 30 speed indicating encoder 46 and the pulses from the wave generator shaft 76 servomotor 80 are supplied to controller 106 which takes the ratio of servomotor encoder pulses to the reference or main shaft encoder 46 pulses and calculates the instantaneous percent of draw. The controller then compares the actual percent of draw with the stored preset percent draw previously selected by the operator via potentiometer 110 located in control console 108. The difference between the preset percent of draw and the instantaneous percent is determined and the resulting correction signal is sent to the servomotor controller which increases or decreases the speed of servomotor 77 correspondingly. Changing the servomotor speed changes the wave generator shaft speed and consequently the Harmonic Drive output shaft speed sufficiently for the chill rolls to stay at a constant speed. Controller 106 compares the stored selected percent of draw signal and the calculated ratio every one millisecond. The compared values are averaged over a 10 ms period and then they are outputted to the servomotor controller 106.

Note that the preset draw is displayed on meter 109 as it is being set by the operator turning potentiometer 110. The selected draw is displayed even if the press is not running. Thus, it is not necessary to bring main shaft 30 up to nominal operating speed before one can determine what is the present percent of draw.

Because, according to the invention, the wave generator shaft 76 is run at many hundreds of revolutions per minute more than according to prior practice, very high resolution or low discrepancy of the percent draw is now achievable. This means that distortion of printed images on a web due to overdraw or underdraw and breakage of the web are now minimized by practicing the invention.

The accuracy of the new system will be appreciated by consideration of the following example using actual numerical values. The encoders can produce 250–500 pulses per revolution. Using counters that have tolerable cost, 20,000 pps can be counted. With the high pulse rate that results from driving the wave generator shaft 76 at very high speed compared to prior art practice, resolution or the departure of the percent draw from nominal setting is very small. With the wave generator shaft running at 1880 rpm or a little more at normal 0.3% draw as was presupposed for the sake of example, the average pulse rates for the servomotor encoder 80 and the reference frequency encoder 46 are about 470,000 ppm or 7833.33 pps. But the encoders can only produce whole digits or integer pulses. Thus, it is possible to have an error of not quite one whole pulse which will be assumed to be a maximum of 0.999 of a pulse. Most of the time the discrepancy will be less but there is no way of knowing what the actual fraction is. Since there are the two encoders and they are each producing around 8000 pps, maximum error or deviation at typical 0.3% draw is $2/8500=0.00025$ or a maximum error of 0.025%. The controller recognizes the error and attempts to adjust the speed up or down as required. There is some overshoot or some undershoot which amounts to about 0.025% also. So the total maximum system error would be about $0.025\% + 0.025\% = 0.05\%$ which is trivial.

Suppose now that the operator has set a certain draw by using potentiometer 110 in FIG. 2 and a decision is made to decrease the percent of draw which means the output shaft 57 of the HD should turn at a lower rpm. Assume, for example, that the present draw setting is such that the wave generator shaft speed is 1880 rpm so 470,000 ppm are produced by the servomotor encoder 80 so the system is at equilibrium and the HD output shaft 57 speed, NF, is 1404.2 rpm and the input shaft speed, NC, is 1408.91 rpm. The present draw is 0.3%. The operator turns the potentiometer which increases the speed of the servomotor 77 such as to, perhaps, increase the output pulse rate of servomotor and wave generator shaft encoder 80 by 1000 ppm. Now the servomotor encoder 80 is producing pulses at 471,000 ppm. Since the servomotor encoder 80 produces 250 pulses per revolution, this amounts to just four additional rpm for the servomotor. Now instead of the wave generator shaft running at 1880 rpm it will run at 1884 rpm. The faster the wave generator shaft 76 of the HD 50 runs, the slower the power output shaft 57 runs. Using Equation 1, assuming that the input speed, NC, holds at 1408.91 so the reference encoder 46 pulse rate remains constant, then the new HD output shaft speed, NF, will be $NF=(1408.91\times 1.01)-(1884/100) = 1404.16$ rpm. This illustrates that a tiny decrease in the output shaft 57 speed, NC, of just 0.04 rpm can be resolved into 1000 ppm by the wave generator encoder 80. Conversely, if the reference pulse frequency from encoder 46 decreases because of a decrease in the speed of main shaft 30 it is necessary to slow down the output shaft 57 of HD 50 in order to maintain a set percent of draw. The correction is made automatically as has been explained.

The instantaneous percent of draw could vary in correspondence with variations in main shaft 30 rotational speed were it not for substantially instantaneous correction of chill roll speed altering the rotational speed of the Harmonic Drive wave generator. During machine operation a signal corresponding to instantaneous draw is developed by taking the ratio of the wave generator encoder 80 output pulses (which correspond to present chill roll speed) in respect to the reference pulse rate from encoder 46 (which correspond to present main shaft 30 speed. This ratio or percentage is compared in control 106 with the preset percent of draw.

As indicated, the controller keeps the draw percent updated with a delay of no more than 10 ms from acquisition of the encoder data in an actual embodiment of the chill roll stand. It will be shown that the rapid updating is pertinent to decelerating the chill rolls to a stop in five seconds which constitutes an emergency stop by definition in this example. In a five second stop interval, 500 updates at 10 ms per update can be made which means that the chill rolls can be stopped under controlled deceleration and the draw ratio or percentage can be maintained down to zero speed such that the web does not break due to an emergency stop.

The matter of maintaining some draw on the web while the high inertia press system and the chill rolls are undergoing an emergency stop will now be discussed in reference to FIG. 1.

An emergency stop is initiated by disconnecting the main drive motor, not shown, for main shaft 30 from the electric power mains at which time the motor is brought to a stop under the influence of dynamic braking. The web may be running through a moderately high speed press at 2500 ft/min or even more. A huge inertia must be overcome to bring the press units and the chill rolls to a stop within seconds. Knowing the mass and speed of moving press mechanical parts and knowing the time in which an emergency stop must be completed, the horsepower which must be overcome can be calculated. For the sake of example and not limitation, the stopping horsepower may be 100 horsepower. In accordance with the invention, the five chill rolls are driven in two groups. The chill rolls in one group on the shafts of pulleys 14, 16 and 18 turn counterclockwise and the rolls in the other group on the shafts of pulleys 15 and 17 turn clockwise as indicated by the arrows on their pulleys in FIG. 1. There are prior art chill roll stands operating which have 4, 5, 6 or 7 chill rolls all driven as one group by a single belt. When the total of the rolls is an even number, according to the invention, both groups will contain the same number of rolls. When the total is an odd number, one group will have one less roll than the other. The three pulleys 14, 16 and 18 in the first group are driven from the output shaft 57 of the HD with a toothed belt 68 which has teeth only on one side. The second group of pulleys 15 and 17 are driven through a toothed belt 60 which has teeth on both sides. Belt 60 drives pulley 19 with its outside teeth and the pulley 64 on the same shaft 63 as the pulley 19 drives the belt 65 which, in turn drives chill roll pulleys 15 and 17 in the second group.

As shown in FIG. 4, shaft 63 extends from a pneumatic brake 62. For an emergency stop the major power to stop the chill roll stand, such as 60% of the power, is derived from the main shaft 30. The balance of 40% of the stopping power must then be derived from brake 62. The brake is applied at the instant the emergency stop (E-stop) command occurs. The command can be produced automatically in response to a condition or by the press operator. In any event, when an E-stop is commanded, a timer marked T and 114 in the digital controller 106 in FIG. 2 receives an electric signal which starts measurement of a time interval. The interval will expire in about five seconds if that is the permissible time for achieving a complete E-stop. During this interval the controller system operates as it does under normal or continuous operating conditions which is to say that the preset percent of web draw is maintained until the chill rolls are at near zero rotational speed. When the brake 62 is set in response to an occurrence of a stop signal, the brake in this example will apply the equivalent of about 40 counter horsepower to the chill rolls. In this example, that would amount to about 40 horsepower being applied to the two chill roll pulleys 15 and 17. For the group of three chill roll pulleys 14, 16 and 18, 60% of the stopping horsepower is derived from the main shaft 30. Just before occurrence of zero speed, little kinetic energy remains in the rolls so the brake would theoretically not be required at this time but it is left on. While the brake is on the main drive must still be powerful enough to overcome the brake. For this reason, the system is designed for the drive to provide for 60 stopping horsepower in this example and the brake to provide 40 horsepower. Thus, the drive is more powerful than the brake by a factor of 1.5.

It will be evident that by dividing the chill rolls into separate groups, such as two groups, the stress on the individual belts for the groups during an E-stop will be less than the stress which is developed in prior art chill roll drives wherein all rolls are driven with a single continuous belt. Hence, smaller and much less expensive belts are used in the new design as compared with prior practice. It has been shown that a single belt of the type which is used in pre-existing chill roll stands must be about 2½ times as wide as any of the belts which are required for the comparable stand disclosed herein and that the single belt costs seven times as much as the three belts 60, 65 and 68.

Tension in the single belt must also be higher which portends shorter belt life. It also puts more load on the journals and journal bearings and reduces their lives.

The reference encoder 46 senses slowing down of the main shaft and the controller responds by slowing down the servomotor 77 at the same rate as the main shaft is slowing down. The response rate of the system is such that the line shaft of the speed is determined within a 10 ms lag time. As previously indicated, timer 114 is set at the instant of the E-stop command. The control system stays active. If the controller were turned off by the E-stop signal it would be impossible to follow the speed down in which case the draw would be unstable. The servomotor 77 cannot be stopped until the main shaft 30 stops because it is needed to check the speed but it must be stopped right after the main shaft comes to a complete stop for safety reasons associated with an emergency stop. So the controller provides for turning off the servomotor at about six or seven seconds after the occurrence of the E-stop command.

Braking power is applied only for an E-stop. In a planned ordinary stop the press is just allowed to coast to a stop. Typically it may take about 25 seconds to come to a complete stop. During an ordinary non-E-stop, the controller is still used since it is still necessary to maintain a percent of draw which does not result in breaking the web.

Figure 6:
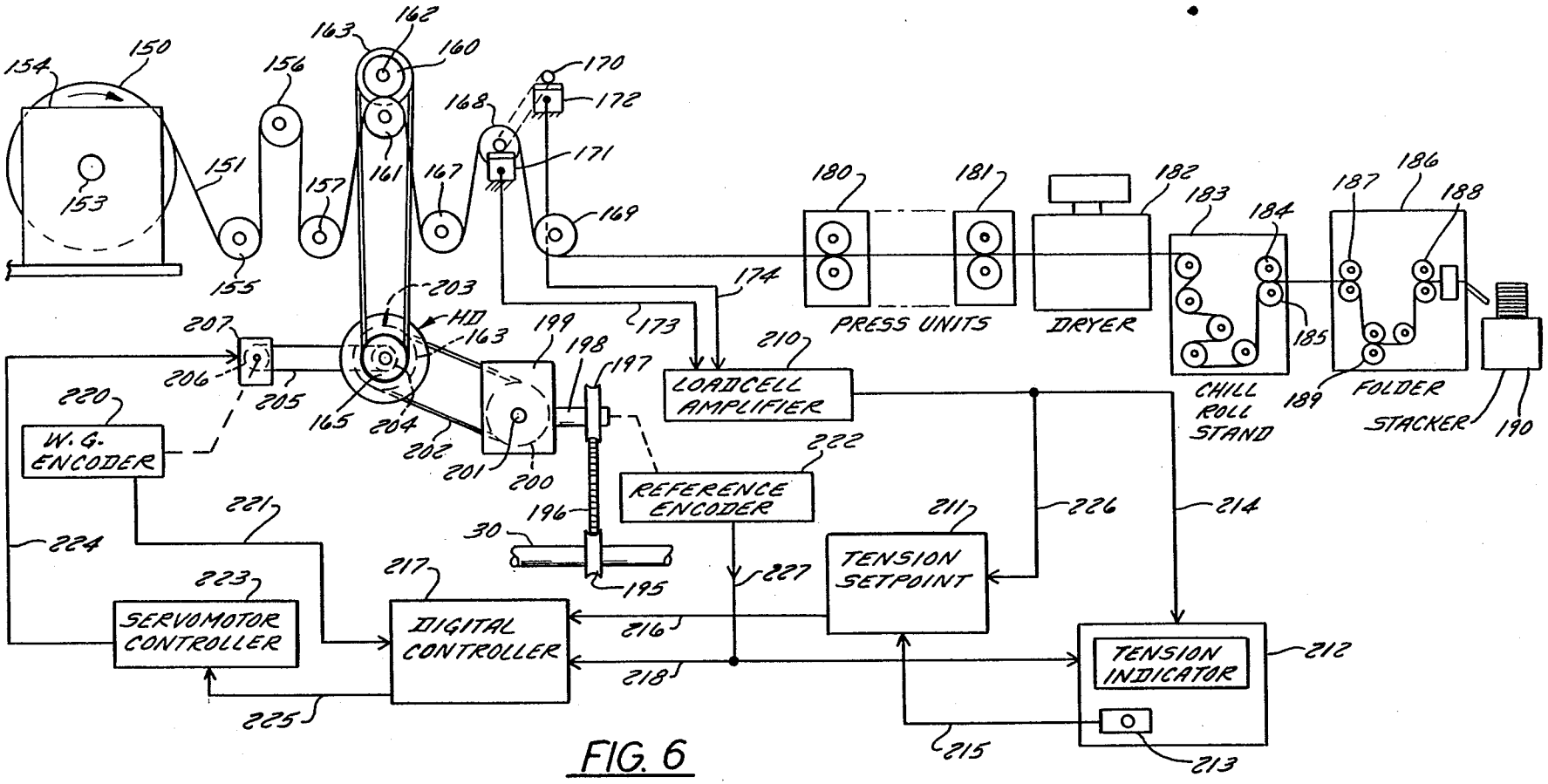
FIG. 6 is a diagrammatic view of a printing press wherein the new tension control system is applied at the infeed end of the press to maintain proper tension in the web between the infeed and the color units of the press.

FIG. 6 is a diagram showing how the new apparatus and method of controlling web tension is used to control tension at the web infeed of a printing press or the like. The parent or unwind roll 150 from which web 151 is drawn is on the mandrel 153 of stand 154. The web is drawn over three rolls 155–157 which symbolize a festooning device which is not elaborated because it is conventional. Web 151 passes between nip rolls 160 and 161 which cooperate to draw the web from unwind roll 150. Fixed on the shaft 162 of nip roll 160 is a toothed pulley 163 which is driven by a toothed belt 164. This belt engages with the toothed pulley 165 which is the power output pulley of Harmonic Drive, HD 166.

After passing through the nip rolls the web passes around three rolls 167, 168 and 169. A shaft 170, represented by small circles, is non-rotating. Roll 168 rotates on the shaft 170. Opposite ends of shaft 170 are supported in or on commercially available load cells 171 and 172. These load cells yield analog signals on lines 173 and 174, respectively, whose magnitudes are proportional to the load on the cells. A constant part of the load and, hence, a constant fraction of the signal results from the weight of the roll 168. The remaining part of the load on cells 171 and 172 is the result of tensile force in the web which is pulling down on roll 168. The invention provides for continuously adjusting the rotational speed of nip roll 160 so as to maintain accurately a constant tension in the web 151 between nip roll 160 and printing cylinders in color unit 180.

The difficulty of drawing from the unwind roll 150 a uniform quantity of web per unit of time so as to maintain constant tension results, to a large extent, from uncontrollable variables in the web which develop before, during and after it is formed into a roll. The moisture content of the web can vary from the outside to the core of the roll. This effects its elasticity. Variations in atmospheric humidity can affect the roll. Winding tightness from the outside to the core of the roll varies. The roll can lack circularity. All of these variables and more preclude removal of a constant quantity of web from the unwind roll and constant tension systems preceding the nip rolls by simply driving the nip rolls 160 and 161 at a constant speed.

In FIG. 6 the web is illustrated as passing from the infeed control region into a printing press system. Two press units for printing differently colored parts of the image are represented by rectangles marked 180 and 181. Usually more than two color units are in use as suggested by the dashed-dot lines between the units. After all colors are printed, the web 151 passes through a hot ambient dryer 182 which evaporates the volatile thinner from the ink and dries it. From the dryer the web goes into the chill roll stand 183 wherein the warm ink is cooled and set. The stand has a pair of nip rolls 184 and 185 which draw the web as described in detail earlier. The web may then pass into a folder 186 wherein there are likely to be three nip roll pairs 187–189 which act on the web and sheets segregated from the web in the course of trimming and folding operations which are performed by mechanisms in the folder, not shown. The finished product is discharged from the folder 186 to a stacker 190.

In FIG. 6 the power for driving the web infeed tensioning device is derived from the main shaft 30 of the press which is given the same reference numeral 30 as in the chill roll stand application of the invention. A toothed pulley 195 on shaft 30 is coupled, by means of a toothed belt 196, to a toothed pulley 197 on the power input shaft 198 of a gear box 199. There is a toothed pulley 200 on the output shaft 201 of the gear box which is coupled by means of a belt 202 to the power input pulley 203 of Harmonic Drive 166. Pulley 203 corresponds to pulley 51 of the strain gearing device or Harmonic Drive depicted in FIG. 3 where it is seen to be the power input for the outer ring gear 52 of the drive. The strain inducer or wave generator shaft 165 pulley is the smallest of the concentric circles on the HD and is shown in dashed lines marked 204 in FIG. 6. The wave generator shaft corresponds to the shaft marked 76 in FIG. 3. In FIG. 6 the shaft is shown symbolically as being driven by a belt 205 on the pulley 206 of a servomotor 207 which can be similar to servomotor 77 in FIG. 2 and other figures and where the belt 105 is equivalent to the belt 205 in FIG. 6. In an actual embodiment, rather than using a belt 205 to drive the wave generator shaft, the shaft of the servomotor can be mechanically coupled directly to the wave generator shaft 76.

In FIG. 6, instantaneous tension or draw on the web 151 after nip rolls 160 and 161 is indicated by the magnitude of the analog signals from the load cells 171 and 172. Indirectly, the tension and, hence, the load cell output signals depends on the rate at which nip roll 160 is driven.

The load cell analog output signals on lines 173 and 174 are in the low millivolt range so they are amplified in amplifier 210. The amplifier then outputs a 0–10 V signal relative to web tension and outputs it to a tension set point board 211. The tension set point board 211 will adjust the 0–10 V signal from the amplifier 210 via the tension potentiometer 213 in control console 212 to the desired tension level sought on the web 151. The tension set point board 213 will then send a signal on wire 216 to the controller 217. The controller 217 is always seeking a constant voltage (for example 10 V) from the tension set point board 211 and adjusts the speed of the servomotor 207 which will adjust tension on the web 11. The controller 217 is constantly changing the speed of the servomotor 207 to maintain a constant tension in the web. As tension changes in the web, the load cells sense it and send the change signals to amplifier 210 and then via line 213 to the tension set point board which, in turn, sends the change (which is proportional to tension in voltage) to the controller 217. The controller senses the change in voltage and adjusts the speed of the servomotor and, hence the speed of the HD 166 output shaft in an effort to increase or decrease the voltage to the initial 10 volts. This loop is continually updated every 10 milliseconds to maintain constant tension of the web.

In this embodiment the tension set point board 211 will take the 0–10 V signal from the amplifier 210 and add or subtract voltage to it. Assume for example that a 7 volt signal from the amplifier 210 is equivalent to 100 lbs. of tension on the web. Also assume the digital controller is programmed to seek a constant voltage of 10 volts from the tension set point board 211. By adjusting the tension potentiometer 213 to the tension set point board it is in effect adding voltage to the 7 volt signal from the amplifier. If the tension potentiometer is adjusted to add 3 volts to this signal, the results would be 7 volts from the amplifier plus 3 volts from the tension potentiometer = 10 volts output to the controller.

If the operator wanted 70 lbs. tension on the web and that was equivalent to 5 volts from the amplifier then the operator would adjust the tension potentiometer 213 until it was adding 5 volts to the amplifier signal. Again 5 volts from the amplifier plus 5 volts from the tension potentiometer = 10 volts to the controller. The controller 217 will constantly change the speed of the driven roll 160 via the servomotor 207 to maintain a 10 volt input from the tension set point board.

It would be accurate to say that the speed of the servomotor controls tension on the web. Controlling the speed of the servomotor strictly by the load cells would be a very unstable system. With this in mind, the controller 217 allows controlling the speed of the servomotor via two variables. For acceptable stability of the servomotor, the load cells can be allowed to control a maximum of 10% of the motor speed. The other 90% is controlled by the same way the draw system is controlled. The controller will follow the reference encoder, which outputs a pulse train relative to lineshaft 30 speed. That speed is then trimmed by the load cell signal for proper tension on the web.

In effect, at least 90% of servomotor 207 effect is derived from the very stable follower system as used in draw control and 10% or less is controlled by the load cells.

As in the draw control implementation described in reference to FIGS. 1–5 the infeed tension control in FIG. 6 employs a servomotor controller 223 for converting the output signals from controller 217 by way of line 225 to servomotor control signals which are delivered by way of line 224. The wave generator encoder 220 performs in the manner of encoder 80 in the draw control. The pulses from encoder 220 are delivered to the controller 217 by way of line 221. The signals from the load cell amplifier, besides being sent to tension set point board 211 over line 226, are also sent to console 212 where they are processed to produce signals for driving the tension indicator which displays the web tension in pounds.

As in the previously discussed embodiment, the wave generator shaft of Harmonic Drive HD 166 is driven at high speed so that-the speed of this shaft is low relative to the speeds of the shaft for the ring gear in the HD 166 for maximizing bearing life. Thus, the encoder 220, whose output pulse rate indicates the speed of the wave generator shaft in the HD 166, produces a pulse train on output line 221 having a rate on the order of 470,000 ppm.

The high pulse rate again means that the resolution is high which also means that the wave generator shaft, whose speed governs the output speed of the HD 166, can be set very accurately. The speed of the nip roll 160 which governs web tension is indicated by the output pulse rate of an encoder 222. Encoder 222 is driven from the shaft 162 of nip roll 60 and produces at least 250 pulses per revolution in this example which translates into hundreds of thousands of pulses per minute where the web 151 is moving usually between 2,000 and 3,000 feet per minute.

We claim:

1. A method of controlling the draw or tension in a web processing machine which is driven by a motor driven main drive shaft, the web being drawn in said machine by a driven roll means and wherein a strain wave gear device having coacting elements including a flexspline, power output shaft, circular spline, and wave generator, is interposed between said main drive shaft and driven roll means to drive said driven roll means rotationally to transport the web, and further the power output shaft of the flexspline of the strain wave gear device is coupled in driving relation to said driven roll means, the spline of said strain wave gear device and a servomotor is coupled to the wave generator of said strain wave gear device to drive the wave generator rotationally, the method including the steps of:

driving said circular spline rotationally at a speed proportional to said main drive shaft, operating said servomotor to drive said wave generator rotationally at a substantially higher speed continuously in one and the same rotational direction in which said circular spline is driven such that when the wave generator is rotating at a predetermined speed there is zero draw in said driven web leading to said driven roll means, repeatedly determining the ratio of the wave generator speed relative to the main drive shaft speed as an indication of the percent of draw, comparing the determined ratio with a preset stored value representing the percent of draw desired in the web, and if said determined ratio is greater than said stored value to indicate that the flexspline power output shaft is rotating at a speed and is driving said driven roll means at a speed which is resulting in the percent of draw exceeding said preset value, then causing said servomotor to increase the rotational speed of said wave generator to reduce the speed of said power output shaft until said determined ratio and said preset value match, and if said determined ratio is less than said preset value, then causing said servomotor to decrease the speed of the wave generator to increase the speed of said output shaft until said determined ratio and preset value match.

2. The method according to claim 1 wherein the minimum rotational speed of the generator is equal to or greater than the speed of the circular spline and the maximum rotational speed is about 5000 rpm.

3. The method according to claim 1 wherein when the wave generator rotational speed is the average of the minimum wave generator speed and the maximum wave generator speed, the percent of draw is approximately zero percent.

4. The method according to claim 1 wherein the rotational speeds of the main drive shaft and the wave generator are determined with encoders which are coupled to the main drive shaft and wave generator, respectively, and which yield at least 250 pulses per revolution of the drive shaft and wave generator, said comparing step including comparing said determined ratio and said preset stored value at least every millisecond and averaging the compared values over an interval of at least every 10 ms and using the result to adjust the servomotor speed to make the preset stored ratio, representing selected percent draw, and the averaged ratio agree.

5. The method according to claim 1 wherein the driven roll means is a chill roll stand having several rolls over which the web runs, including the steps involved with the machine making an emergency stop within a short time interval, comprising having the several rolls divided into at least two groups and having the groups driven by the power output shaft of said strain wave gear device, deenergizing the motor which drives the main drive shaft of the machine concurrently with initiating an emergency stop, initiating braking of at least one of the groups of rolls upon initiation of the emergency stop, setting a timer upon initiation of the emergency stop to start measurement of a time interval, keeping the servomotor running and continuing to determine the ratio of the wave generator speed relative to the main drive shaft speed so approximately said preset stored value is maintained as the rolls are slowing down, and after said rolls have stopped rotating and said time interval has expired, turning off said servomotor.

6. The method according to claim 5 wherein said time interval is not shorter than the time in which said rolls can be stopped.

7. The method according to claim 5 wherein said time interval is at least 6 seconds and not more than 7 seconds.

8. Apparatus for controlling the tension or draw of a web in a web processing machine wherein the web is run over driven rolls and between driven nip rolls and the machine is driven from a motor driven main shaft, the apparatus including:

a fixedly mounted strain wave gear device comprising a housing, a toothed flexspline and a shaft therefor journaled for rotation in said housing, a toothed circular spline concentric to said flexspline and an axially bored shaft for said circular spline journaled for rotation in said housing, a wave generator arranged coaxially with and inside of said flexspline and adapted to force the teeth of the flexspline into engagement with the teeth of the circular spline at circumferentially spaced apart places, a wave generator shaft on which said wave generator is mounted, said wave generator shaft extending through the bore of said shaft for said circular spline, and bearings on which said wave generator shaft is journaled for rotation inside of and independently of said axially bored shaft for said circular spline, means for coupling said main shaft of the machine in driving relation to a selected one of said shaft for said circular spline or said shaft for said flexspline to input power to said strain wave gear device and for the other of said shafts to output power from said device, a first encoder rotatable to produce electric pulses at a rate depending on the rotational speed of said main shaft, said encoder producing a predetermined number of pulses per revolution, means for coupling said driven shaft of the device for output of power to said rolls to drive the rolls rotationally, a servomotor and means for coupling said servomotor to said wave generator shaft of the device to drive said wave generator shaft continuously in one direction of rotation and at a speed substantially higher than the speed at which the shaft selected for power input is being driven, a second encoder rotatable to produce electric pulses at a rate depending on the rotational speed of said servomotor, said second encoder producing a predetermined number of pulses per revolution, controller means and means for storing a preset value corresponding to the desired percent of draw of the web, means in said controller means for taking the ratio of the number of pulses per unit of time produced by said first encoder to the number of pulses produced during the same time by said second encoder and comparing the ratio with said stored preset value, said controller means producing an error signal representative of any difference between said ratio and said preset value, a servomotor controller responsive to an error signal representative of the ratio being greater than said preset value to increase the speed of the servomotor and wave generator shaft to reduce the rotational speed of the shaft selected for output of power and responsive to an error signal representative of the ratio being less than said preset value to decrease the speed of the servomotor and wave generator shaft to increase the rotational speed of the shaft selected for the output of power.

9. The apparatus according to claim 8 wherein the minimum speed at which said wave generator shaft is driven during machine operation is about 1600 rpm.

10. The apparatus according to claim 8 wherein the minimum and maximum speeds at which said wave generator shaft is driven during machine operation are, respectively, 1600 rpm and 3000 rpm.

11. The apparatus according to claim 8 wherein the maximum speed at which said wave generator shaft is driven is 5000 rpm.

12. The apparatus according to claim 8 including a meter for indicating the percent or draw which has been set.

13. The apparatus according to claim 8 wherein said encoders produce at least 250 pulses per revolution.

14. The apparatus according to claim 8 wherein said ratio is determined at least every 1 ms and result is averaged over at least every 10 ms at which time said comparison with said preset value is made.

15. The apparatus according to claim 8 wherein said driven rolls are the plurality of rolls of a chill roll stand and said means for coupling comprises:

first and second toothed driving pulleys fastened to said selected power output shaft for output of power from the strain wave gear device, said driven rolls having shafts and a toothed pulley on each shaft, a first closed loop toothed belt having inside and outside teeth, the inside teeth engaged with and driven by the teeth on said first toothed pulley, a journaled shaft and two toothed pulleys fastened on said journaled shaft, the outside teeth of said first belt engaging the teeth of one of the two pulleys to drive both pulleys rotationally, the driven rolls being divided into groups, each roll in each group having a toothed pulley rotatable therewith, a second closed loop toothed belt running on and translated by the other of said two toothed pulleys and said second belt running on the toothed pulleys of the driven rolls in one group for driving the rolls rotationally, a third closed loop toothed belt running on said second of the driving pulleys which is on the shaft selected for output of power from said strain wave gear device and running on said toothed pulleys of the driven rolls in another of the groups for driving said rolls rotationally.

16. The apparatus according to claim 15 including a brake device operative to apply braking force on command to said journaled shaft.

17. Apparatus for controlling the tension or draw of a web which runs over a plurality of rotationally driven chill rolls and between nip rolls in a chill roll stand which chill rolls draw the web from printing apparatus comprising:

a motor driven main shaft for driving the printing apparatus, a strain wave gear power transmission device having a flexspline shaft operatively coupled to said main shaft for being driven rotationally thereby and having a circular spline shaft, first and second toothed driving pulleys fastened to said flexspline shaft, a toothed idler pulley, a first closed loop toothed belt having teeth on both sides, the inside of the belt running on and engaged with the first toothed driving pulley and the idler pulley, a journaled shaft and two toothed pulleys fastened on said journaled shaft, the teeth on the outside of said first belt engaging one of the first and second toothed driving pulleys to drive said pulleys rotationally, the rolls of the chill roll stand being divided into two groups, each roll in each group having a toothed pulley rotatable with the roll, a second closed loop toothed belt running on and translated by the other of the first and second toothed driving pulleys and running on the toothed pulleys of the rolls in one group for driving the rolls rotationally, a third closed loop belt running on the second driving pulley which is on the flexspline shaft of strain wave gear device and running on the toothed pulleys of the rolls in another of the groups for driving said rolls rotationally.

18. Apparatus for controlling the tension or draw of a web at the infeed of a web processing machine wherein the web is drawn from an unwind roll of web by engagement between nip rolls at least one of which is driven rotationally, said machine being driven by a motor driven main shaft, said apparatus comprising:

a strain wave gear power transmission device including a housing, a power output shaft journaled in said housing and a toothed flexspline fixed to the power output shaft, a power input shaft journaled in said housing coaxially with said power output shaft, and a circular spline carried on a circular spline shaft inside of and concentric to the flexspline, said circular spline shaft having an axial bore and bearings in said bore, a wave generator shaft extending axially through said bore and journaled in said bearings, and a wave generator mounted on said wave generator shaft for rotating to engage the portions of the teeth of the flexspline with portions of the teeth of the circular spline in sequence, means for coupling said main shaft in driving relation to a selected one of said circular spline shaft of said power output shaft for input of power to said power transmission device and for the other of said shafts to output power from said device, means for coupling the shaft for power output from said device to said driven nip roll for driving the roll rotationally and drawing web from the unwind roll, a first encoder operative to produce electric pulses at a rate depending on the rotational speed of the main shaft, a servomotor coupled to said wave generator shaft and operative to drive said wave generator shaft continuously at a substantially higher speed in one and the same direction in which the power output shaft of said device turns, increasing in which the power output shaft of said device turns, increasing the rotational speed of said servomotor causing said power output shaft speed to decrease and decreasing the speed causing said power output shaft speed to increase, a second encoder operative to produce electric pulses at a rate depending on the rotational speed of the servomotor, web tension sensing means arranged to sense tension in the web between said nip rolls and said web processing machine and means operative to produce an analog signal which varies in magnitude in correspondence with the sensed tension in the web, amplifier means having input means for receiving said analog signal and having output means for output of the resulting amplified analog voltage signal, adjustable means for selectively adding sufficient voltage to said analog voltage signal to make the sum of the voltages be equal to a predetermined voltage, controller means having an input for receiving said predetermined voltage and an output, a servomotor controller, said controller means operating to output a signal to said servomotor controller to cause adjustment of the speed of said servomotor and wave generator shaft to hold said predetermined voltage and the web tension constant, means for storing a signal corresponding to a desired web tension, said controller means having input means for receiving the encoder pulses and operating to take the ratio of the encoder pulses representative of the main shaft speed and the encoder pulses representative of the servomotor and wave generator shaft speed, said controller means comparing said ratio with said stored signal for determining any error and producing an error signal, said servomotor controller responding to the error signal by changing the speed of the servomotor and wave generator shaft until the output shaft speed of the strain wave gear device changes by an amount that results in eliminating any error.

* * * * *

UNITED STATES PATENT AND TRADEMARK OFFICE

CERTIFICATE OF CORRECTION

PATENT NO. : 4,945,293

DATED : July 31, 1990

INVENTOR(S) : Eugene W. Wittkopf and Glen B. Leanna

It is certified that error appears in the above—identified patent and that said Letters Patent is hereby corrected as shown below:

Column 21, Line 26:
Between "the" and "spline" insert --- main drive shaft is coupled in driving relation to the circular ---.

Column 21, Line 61:
Between "the" and "generator" insert --- wave ---.

Column 25, Line 12:
Between "shaft" and "said" delete "of" and substitute --- or ---.

Column 25, Line 27:
After "increasing" delete "in which the power output shaft of said device turns, increasing"

Signed and Sealed this

Twelfth Day of May, 1992

*Attest:*

DOUGLAS B. COMER

*Attesting Officer*

*Acting Commissioner of Patents and Trademarks*